US007562611B2

(12) United States Patent
Chen

(10) Patent No.: US 7,562,611 B2
(45) Date of Patent: Jul. 21, 2009

(54) PLANETARY TUBING CUTTER

(75) Inventor: Kuo-Raid Grant Chen, Cary, NC (US)

(73) Assignee: Axon LLC, Raleigh, NC (US)

( * ) Notice: Subject to any disclaimer, the term of this patent is extended or adjusted under 35 U.S.C. 154(b) by 165 days.

(21) Appl. No.: 11/844,057

(22) Filed: Aug. 23, 2007

(65) Prior Publication Data

US 2007/0283568 A1 Dec. 13, 2007

Related U.S. Application Data

(62) Division of application No. 10/890,699, filed on Jul. 14, 2004, now Pat. No. 7,275,469.

(51) Int. Cl.
*B26D 5/08* (2006.01)
*B26D 1/00* (2006.01)

(52) U.S. Cl. ..... 83/597; 83/607; 83/663; 83/647.5; 83/651; 83/924; 83/946; 30/92; 30/97; 30/101; 53/296; 53/389.3; 82/1.11; 82/47; 82/84; 82/85

(58) Field of Classification Search ..... 83/13, 83/651, 92, 364, 597, 607, 639.1, 54, 598, 83/924, 370, 647.5, 602, 876, 883, 878, 946, 83/647, 663, 356.3, 303, 410.9, 411.1, 411, 83/411.7, 914; 493/288, 363, 372; 156/556, 156/86, 353, 215, 443, 521; 53/296–298, 53/389.3, 64, 65, 68, 551, 552, 557, 563; 30/101, 92, 97, 102, 70, 72, 72.2; 82/1.11, 82/47, 113, 83, 84, 85
See application file for complete search history.

(56) References Cited

U.S. PATENT DOCUMENTS 1,930,219 A * 10/1933 Zimber ..... 445/50
2,112,396 A 3/1938 Corrigan
2,373,472 A 4/1945 Haumiller
2,679,686 A 6/1954 Ingwer et al.
3,478,627 A 11/1969 Marion
3,577,813 A * 5/1971 Vorontsov ..... 81/9.51
3,851,515 A * 12/1974 Hautau ..... 72/121
3,860,330 A 1/1975 Persson
4,347,664 A 9/1982 Petrillo
4,500,180 A * 2/1985 Stevens ..... 351/234
4,739,685 A 4/1988 Ricci
4,813,314 A 3/1989 Kwech
5,531,858 A 7/1996 Hong
5,566,527 A * 10/1996 Drewitz ..... 53/295
5,791,220 A 8/1998 Liao (Continued)

*Primary Examiner*—Ghassem Alie
(74) *Attorney, Agent, or Firm*—Thompson Hine LLP

(57) ABSTRACT

The planetary tubing cutter of the invention provides a gearing assembly having a pair of ring gears and a number of pinions with a blade affixed to each pinion. The ring gears are parallel to one another and are individually driven. The pinions are rotatably mounted to a side surface of one ring gear and engage a sun gear assembled to the other ring gear. When the ring gears rotate at the same speed, the pinions and blades do not revolve around their respective axes, and when one ring gear rotates at a speed different from the other ring gear, the pinions and blades revolve about their respective axes, intercepting and cutting a tube passing through an axial passage through the ring gears.

4 Claims, 2 Drawing Sheets

U.S. PATENT DOCUMENTS

| | | | | |
|---|---|---|---|---|
| 5,916,343 | A | 6/1999 | Huang et al. | |
| 5,957,020 | A | 9/1999 | Truemner et al. | |
| 5,970,685 | A | 10/1999 | Huang | |
| 6,065,212 | A | 5/2000 | Lazarevic | |
| 6,202,307 | B1 | 3/2001 | Wrate | |
| 6,430,793 | B1 | 8/2002 | Pedersoli | |
| 6,829,971 | B1 | 12/2004 | Huang et al. | |
| 7,033,301 | B2 * | 4/2006 | Kimes | 475/340 |
| 2003/0084772 | A1 | 5/2003 | Shen | |
| 2005/0126715 | A1 * | 6/2005 | Hong | 156/459 |
| 2006/0090624 | A1 | 5/2006 | Chen | |

* cited by examiner

PLANETARY TUBING CUTTER

CROSS-REFERENCES

This application is a divisional of and claims priority to U.S. application Ser. No. 10/890,699, filed Jul. 14, 2004, now U.S. Pat. No. 7,275,469, the entire specification of which is incorporated herein by reference.

FIELD OF THE INVENTION

The present invention relates to the field of cutting mechanisms, and more particularly to cutting mechanisms adapted for cutting tubing in a process machine.

BACKGROUND OF THE INVENTION

Thin wall plastic tubing is often used for over-wrapping product containers, typically bottles, in which products, for example personal hygiene, pharmaceutical or food products, are shipped. In one form, the plastic tubing is applied as a label over a major portion of the container to identify the product and/or enhance the appearance of the container. In another form, the plastic tubing provides a tamper-evident band that covers the container cap and neck, serving to indicate whether the container has been opened after shipping. In many cases the plastic tubing is processed so as to be shrinkable by the application of heat after a cut length of tubing has been placed over the container, and thus the tubing conforms snugly to the contours of the container.

The subject plastic tubing labels and tamper-evident bands are applied to product containers in manufacturing environments, therefore process speed, tubing length consistency and neatness of the cut edge are important factors. Most known machines for the application of thin wall plastic tubing to containers employ a scissor-type double blade cutter or a guillotine-type single blade cutter. Another cutter type is described in U.S. Pat. No. 5,531,858 entitled "Shrinkable Label Inserting Machine" in which a plurality of blades are mounted circumferentially around a passage through which a thin wall plastic tube is conveyed. Each of the blades is mounted rotatably on a wheel that is in contact with a driven band, e.g. a belt or chain. When an appropriate length of tubing has moved through and extends beyond the passage, the band is rotated to cause the blades to swing in plural overlapping arcs, cutting the tubing. A drawback of the cutter described in the '858 patent is that for each cut to occur, the band and the plurality of wheels and blades must be driven from a stop to a high rotational speed in a minimal time interval. This rapid acceleration and subsequent deceleration requires a relatively large expenditure of energy and causes relatively great wear of machine components. A further drawback of the '858 patent cutter is that the mechanism is limited to a small range of tubing diameters, and the diameter of the cutter mounting circle as well as the number of cutters must be changed to accommodate a significantly different tubing diameter. The cutter invention disclosed below provides the needed speed, consistency and neat cut while minimizing the power requirement and amount of wear. Furthermore, the present invention cutter is capable of handling a greater range of tubing diameter than previously known without requiring equipment modification.

SUMMARY OF THE INVENTION

The present invention provides an apparatus for efficiently cutting thin walled tubing in a process machine. A blade is rotatably mounted on each of a number of pinions to reside in a plane that is perpendicular to the feed path of the tubing. The pinions are mounted to a first plate that is rotated in a selected direction. The pinions engage a sun gear that is rotated in the same direction as the plate. When the sun gear rotates at the same speed as the plate, the blades remain in a fixed angle relative to an axial opening through which a length of tubing is fed. When the sun gear is made to rotate at a different speed than the plate, the angle of the blades relative to the tubing feed opening is changed. Whereas the plate and the sun gear, thus also the pinions and blades, are rotating at a speed around the tubing, a slight change in the angle of the blades, e.g. 90° or less, moves the blades into cutting engagement with the tubing. In the preferred embodiment of the invention, the blades are caused to rotate 90° to cut the tubing and then an additional 270° to return to rest position.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
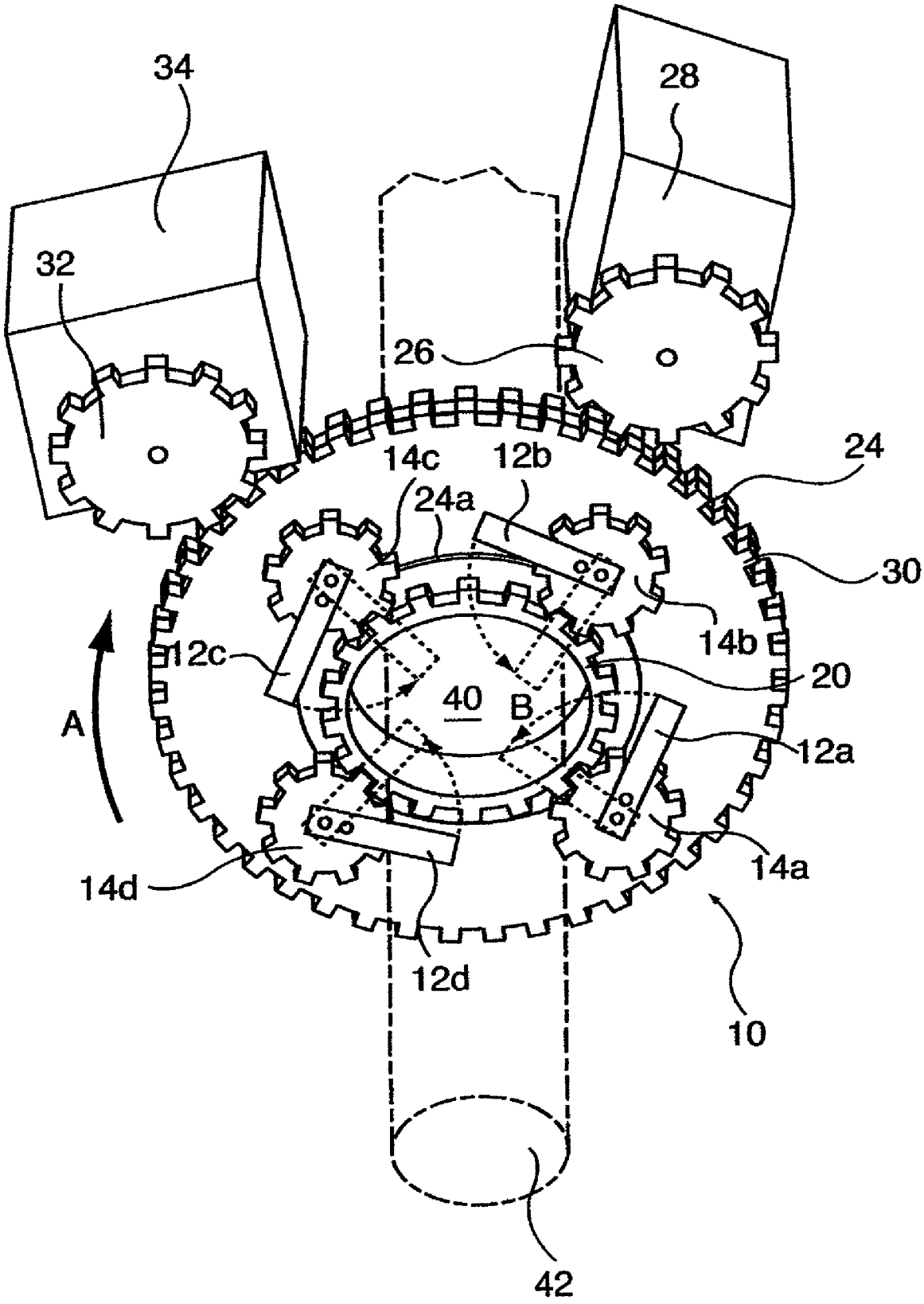
FIG. 1 is a perspective illustration of the present invention as seen from the tubing exit position with a length of tubing shown in dashed lines extending therethrough.
Figure 2:
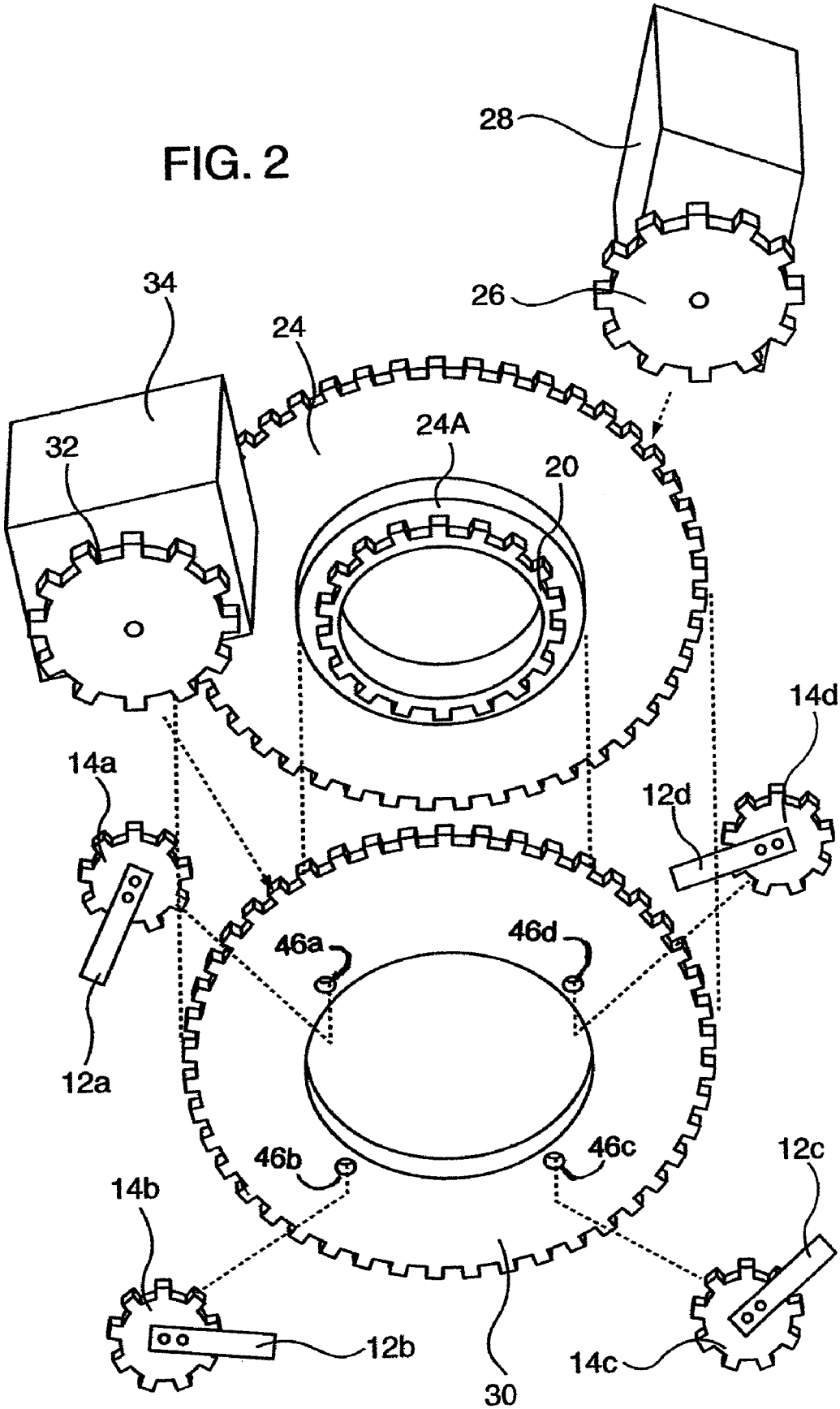
FIG. 2 is an exploded perspective illustration of the apparatus of FIG. 1, drawn in reduced scale.

As noted above, FIG. 2 is an exploded version of the apparatus of FIG. 1, provided for the purpose of illustrating the structure and interrelationship of the mechanical components illustrated. The description below relates primarily to the assembled planetary tubing cutter 10 as shown in FIG. 1, while reference to FIG. 2 may be used to more distinctly determine individual component configurations. Details of mounting framework and bearings have been omitted for reasons of clarity, and such will be apparent to those skilled in the art.

In the planetary tubing cutter apparatus 10, a first ring gear 24 is rotatably mounted as a driving element in engagement with a spur gear 26 driven by a first motor 28. Motor 28 is of any type capable of driving ring gear 24 at a constant selected speed through spur gear 26 mounted thereto. A preferred speed for the rotation of ring gear 24 to accomplish the objectives of the invention is in the range of 200-600 rpm, and most preferably about 300 rpm. A sun gear 20 is fixedly attached coaxially so as to rotate with ring gear 24. Alternatively, sun gear 20 and ring gear 24 may be integrally formed as a single unit. A passage 40 is formed axially through ring gear 24 and sun gear 20 with a diameter sufficient to allow tubing 42 to pass through for label or tamper-evident application onto a selected container. Tubing 42 is illustrated as elliptical in cross sectional shape, although in other applications, tubing 42 may be round, square or another shape.

A second ring gear 30 is formed as a drive element having an outer diameter that is similar to the outer diameter of first ring gear 24 and an inner diameter of a size sufficient to allow sun gear 20 to pass and slidingly engage shoulder 24*a*. When assembled, first ring gear 24 resides above second ring gear 30 which resides above sun gear 20, making a three-tier gear system. Second ring gear 30 is mounted to be in driving engagement with a second motor 34, having a spur gear 32 assembled thereto. Second motor 34 is of a type capable of driving second ring gear 30 at a speed that is equal to, or to vary the speed to be greater than, or less than, the speed at which first ring gear 24 is driven. Typically, second motor 34 includes a gear box to enable greater torque to be exerted when accelerating second ring gear 30, since such acceleration is preferably rapid to make the cutting of tube 42 both quick and clean. First ring gear 24 and second ring gear 30 are supported on bearings (not shown) at positions near their respective peripheries so as to leave their central areas unobstructed for passage 40.

The lower face of second ring gear 30 is substantially a flat plate formed with a series of holes 46*a*-46*d* for mounting a series of driven elements, such as pinions 14*a*-14*d*, so as to be in driving engagement with sun gear 20. Each pinion 14*a*-14*d* is rotatably mounted on a shaft that is sized to fit in respective holes 46*a*-46*d*. Blades 12*a*-12*d* are fixedly mounted to a face of each of respective pinions 14*a*-14*d* that is distal from second ring gear 30. When pinions 14*a*-14*d* are assembled to the flat surface of second ring gear 30, and second ring gear 30 is mounted rotatably to first ring gear 24, the mating teeth of pinions 14*a*-14*d* are meshed with the teeth of sun gear 20 in a position so that each of blades 12*a*-12*d* resides at a similar angular orientation with respect to the center of passage 40, e.g. perpendicular to a radius of passage 40. It is to be understood that whereas the preferred embodiment of the invention disclosed contains four pinion and blade units, a different number of such units may be used according to the requirements of the process and the size of the tubing to be cut.

When assembled as described above, the relative speed of first ring gear 24 and second ring gear 30 controls the angular movement of blades 12*a*-12*d*. With first ring gear 24 and second ring gear 30 being driven at substantially equal speeds, sun gear 20 travels in synchronization with the plate surface of second ring gear 30 to which pinions 14*a*-14*d* are mounted, and blades 12*a*-12*d* remain in their initial angular positions. When second ring gear 30 is driven at a speed different from the speed of sun gear 20, their relative rotation causes pinions 14*a*-14*d* to rotate on their respective shafts, causing blades 12*a*-12*d* to swing to intersect and cut tubing 42.

In operation, tubing 42 is fed through passage 40 in increments, i.e. a length of tubing 42 is advanced and cut, and then awaits a container for mounting. When a container approaches a selected position, a sensor activates a signal which cuts a previously advanced length of tubing 42 and advances a subsequent length of tubing 42 to discharge the cut length onto the container. When the first length of tubing 42 is discharged onto a container, a subsequent length of tubing 42 is fed through passage 40. Thus the conveyance of tubing 42 is stopped for a short time interval between tubing segments being fed through passage 40. Tubing 42 is cut during the short stop. In the illustrated embodiment, first and second ring gears 24 and 30 are rotating clockwise, as indicated by arrow A, at a synchronous speed of about 500 rpm. When the tubing is stopped, a second signal is transmitted to cause motor 34 to change speed. By increasing the rotational speed of second ring gear 30 while maintaining the original rotational speed of sun gear 20, pinions 14*a*-14*d* will be caused to swing in the direction indicated by arrow B, bringing the leading, cutting edge of blades 12*a*-12*d* through an arc of 90° into engagement with tubing 42. The rotational speeds of second ring gear 30 and sun gear 20 may, optionally, be again synchronized, thereby holding blades 12*a*-12*d* extended toward the center of passage 40. At the preferred speed of 300 rpm, each blade 12*a*-12*d* completes its required circuit of one-quarter of a revolution in approximately 0.03 seconds, separating the lower portion of tubing 42 from the supply. After tubing 42 is cut, the speed of second ring gear 30 is again increased to be above the speed of sun gear 20 to bring blades 12*a*-12*d* through an arc of 270° and back to their initial positions. Moving blades 12*a*-12*d* through a 270° arc in the forward-travel direction, rather than a 90° arc in the reverse direction, is preferred to keep blades 12*a*-12*d* clear of tubing 42 during the return movement to permit a subsequent length of tubing 42 to be advanced freely. The speed of second ring gear 30 is then reduced into synchronization with the speed of sun gear 20, stopping the relative rotation of pinions 14*a*-14*d*. In practice, a single speed change between second ring gear 30 and sun gear 20, maintained for a time sufficient for pinions 12*a*-12*d* to undergo a full rotation, in combination with the rotation of the entire planetary cutter apparatus, provides a sufficient cutting stroke length for most tubing sizes.

While the description above discloses a preferred embodiment of the present invention, it is contemplated that numerous variations and modifications of the invention are possible and are considered to be within the scope of the claims that follow.

What is claimed is:

1. A planetary tubing cutter, comprising:

a. a first rotational drive element having a passage formed axially therethrough;

b. a second rotational drive element having a passage formed axially therethrough, wherein the first and the second rotational drive elements are coaxial;

c. a plurality of driven elements mounted to the first rotational drive element for movement therewith, the plurality of driven elements in contact with a portion of the second rotational drive element such that when the first and second rotational drive elements are rotated in the same direction at a synchronous speeds, the plurality of driven elements do not rotate relative to the first and second rotational drive elements, and when the first and second rotational drive elements are rotated in the same direction at non-synchronous speeds, the plurality of driven elements rotate relative to the first and second rotational drive elements;

d. a plurality of blades, each blade extending from a corresponding one of the plurality of driven elements for rotation therewith, the blades sized such that when the plurality of driven elements are rotated relative to the first and second rotational drive elements, the blades are rotated to intersect and cut tubing as the tubing passes through the axial passages of the first and second rotational drive elements.

2. The apparatus of claim 1 wherein each of the first and second rotational drive elements and the plurality of driven elements comprises a corresponding toothed gear structure.

3. The apparatus of claim 2 wherein rotation of the first and second rotational drive elements is achieved via first and second motors geared respectively with the first and second rotational drive elements.

4. The apparatus of claim 2 wherein a first motor is connected to drive the first rotational drive element, a second motor is connected to drive the second rotational drive element, at least one of the first and second motors capable of varying speed in a selected manner.

* * * * *